United States Patent [19]

DiFrancesco et al.

[11] 4,121,819

[45] Oct. 24, 1978

[54] ROTARY VACUUM FEEDER/TRANSPORTER

[75] Inventors: Alphonse Benjamin DiFrancesco, Penfield; John Charles Shear, Rochester, both of N.Y.

[73] Assignee: Eastman Kodak Company, Rochester, N.Y.

[21] Appl. No.: 807,992

[22] Filed: Jun. 20, 1977

[51] Int. Cl.[2] ..... B65H 3/10

[52] U.S. Cl. ..... 271/96; 271/108

[58] Field of Search ..... 271/96, 108, 94, 95, 271/99, 100, 101, 107, 276, 196; 214/8.5 D

[56] References Cited

U.S. PATENT DOCUMENTS

| | | | |
|---|---|---|---|
| 1,618,182 | 2/1927 | Frohn | 271/96 |
| 2,033,849 | 3/1936 | Mudd | 271/94 |
| 2,834,596 | 5/1958 | Halahan et al. | 271/99 |
| 2,861,803 | 11/1958 | Halahan et al. | 271/94 X |
| 3,005,565 | 10/1961 | Doane et al. | 271/96 X |
| 3,212,772 | 10/1965 | Ward | 271/96 |
| 3,674,255 | 7/1972 | Arnell | 271/99 X |

FOREIGN PATENT DOCUMENTS

| | | | |
|---|---|---|---|
| 636,079 | 9/1936 | Fed. Rep. of Germany | 271/94 |
| 1,139,851 | 11/1962 | Fed. Rep. of Germany | 271/95 |

*Primary Examiner*—Bruce H. Stoner, Jr.
*Attorney, Agent, or Firm*—L. P. Kessler

[57] ABSTRACT

A feeder/transporter having a ported hollow cylindrical vacuum housing and an internal complimentary shaped control valve. The housing is mounted for rotation about an axis located so as to position a sheet receiving outer surface of the housing for movement in a path from adjacent to a tray for supporting a stack of sheets toward a remote location to which the sheets are to be fed. The control valve is non-rotatably supported on the axis of the housing, and is mounted for reciprocable movement along the axis to control the opening and closing of ports in the housing. The control valve has an opening extending for a portion of its circumference with a series of port-blocking tabs extending into the opening. The tabs are positioned during the reciprocating movement of the control valve, in timed relation to the rotation of the vacuum housing, to selectively open the ports of the housing to effect seriatim sheet feeding and block the ports of the housing to substantially eliminate drag on the trailing portion of fed sheets, and to prevent possible premature feeding of subsequent sheets.

8 Claims, 6 Drawing Figures

ROTARY VACUUM FEEDER/TRANSPORTER

BACKGROUND OF THE INVENTION

1. Field of the Invention

This invention relates to a feeder/transporter for feeding sheets seriatim from a stack and transporting the sheets along a path, and more particularly to a valve-controlled rotary vacuum sheet feeder/transporter.

2. Description of the Prior Art

In many applications in the printing and copy/duplicating fields, it is necessary to feed sheets seriatim from a stack and thence transport the sheets along a path to a remote location. Apparatus for feeding and transporting sheets are generally either of a mechanical or of a vacuum type. Mechanical equipment, such as scuff feeders or belt transports, require frictional interaction with the sheet to induce movement of the sheet. Vacuum apparatus on the other hand use pneumatic forces to maintain a sheet in contact with a feeder or transporter as the feeder or transporter is moved.

As may be readily appreciated, feeding sheets from a stack presents different handling problems than transporting sheets along a travel path. In feeding sheets from a stack, it is generally necessary to insure that only one sheet is fed at a time, with the position of a sheet being of secondary consideration; on the other hand, in transporting sheets, it is often necessary to provide accurate control over the position of the sheet without consideration for multiple sheet handling. The mechanical and vacuum apparatus each have certain advantages to recommend their use for feeding or transporting sheets, and either type may be selected for a particular application depending upon the overall design considerations of the equipment in which it is to be used.

It is desireable to use vacuum apparatus as feeders in situations where feeding of such sheets seriatim is of particular importance. Such apparatus can be controlled to accurately pick single sheets from a stack. While mechanical feeders could also be employed, a double sheet rejection mechanism is usually required to assure single sheet feeding. Vacuum apparatus also have advantages in transporting sheets in a curved path in that positive control of a sheet may be maintained from one side of the sheet (as opposed to contacting the sheet on both sides thereof). However, as noted above, in utilizing vacuum apparatus, movement of the apparatus must be provided in order to cause the sheets to move. Furthermore, in transferring sheets from one portion of the apparatus to another, such as between one transporter and a subsequent transporter functioning at a higher transport speed, it is desireable that the vacuum for the first transporter be cut off after the second transporter receives the sheet to prevent drag on the sheet.

SUMMARY OF THE INVENTION

The vacuum sheet feeder/transporter of the present invention will feed sheets seriatim from a stack and transport the sheets to a remote location without presenting undue drag on the sheets or causing premature feeding of subsequent sheets. The feeder/transporter has a ported hollow cylindrical vacuum housing and an internal complimentary shaped control valve. The housing is mounted for rotation about an axis located so as to position a sheet receiving outer surface of the housing for movement in a path from adjacent to a tray for supporting a stack of sheets toward a remote location to which the sheets are to be fed. The control valve is non-rotatably supported on the axis of the housing, and is mounted for reciprocating movement along the axis to control the opening and closing of ports in the housing. The control valve has an opening extending for a portion of its circumference, with a series of port-blocking tabs extending into the opening. The tabs are positioned during the reciprocating movement of the control valve, in timed relation to the rotation of the vacuum housing, to selectively open the ports of the housing to effect seriatim sheet feeding and block the ports of the housing to substantially eliminate drag on the trailing portion of fed sheets, and to prevent possible premature feeding of subsequent sheets. The valve additionally has outboard body segments which may be selectively positioned to cause outboard ports on the feeder/transporter to become selectively operative only when handling extra long sheets to maintain control over the marginal edge thereof.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
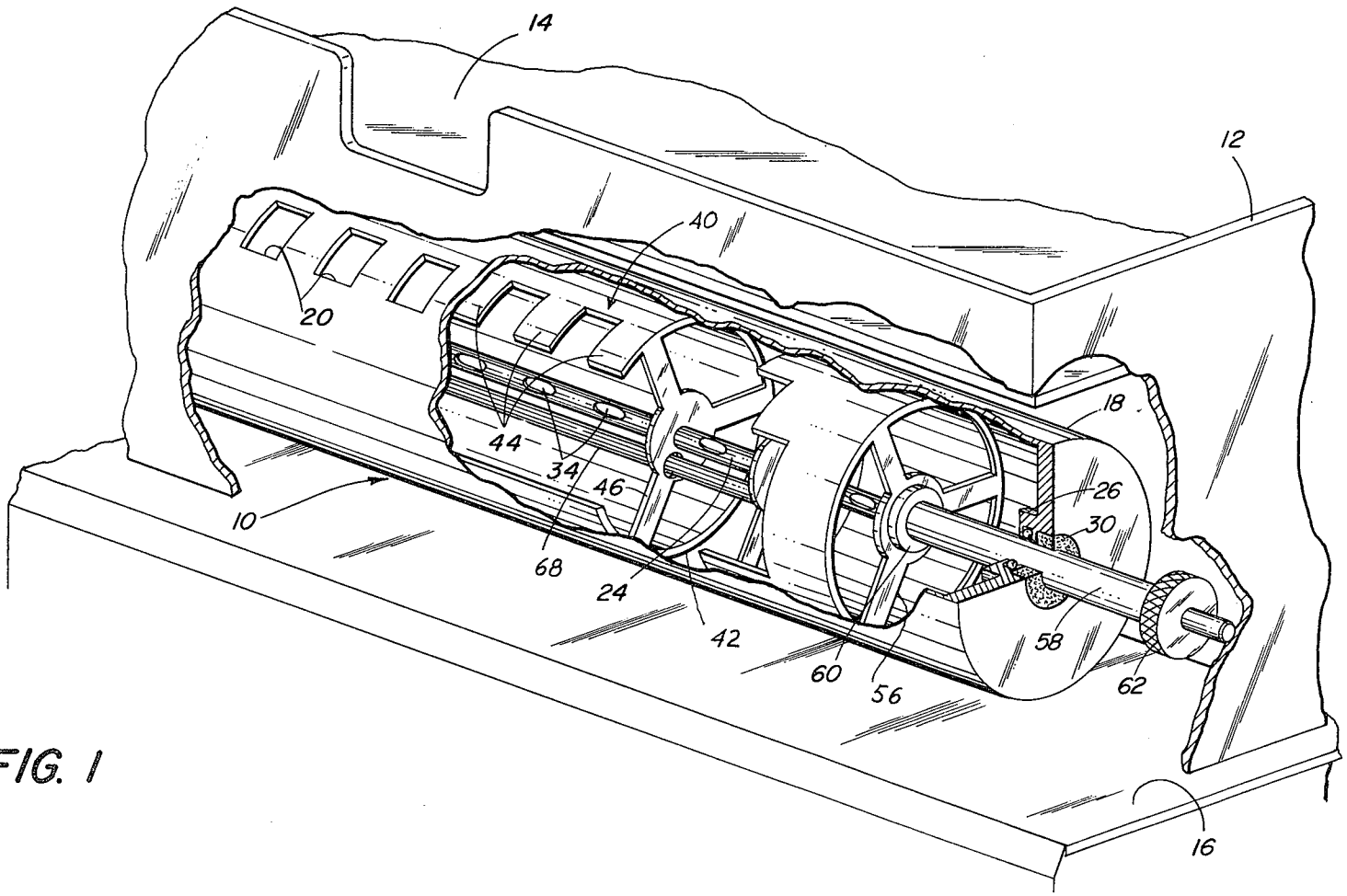
FIG. 1 is a perspective view of a sheet handling apparatus utilizing a rotary vacuum feeder/transporter according to this invention, portions being broken away to facilitate viewing.
Figure 2:
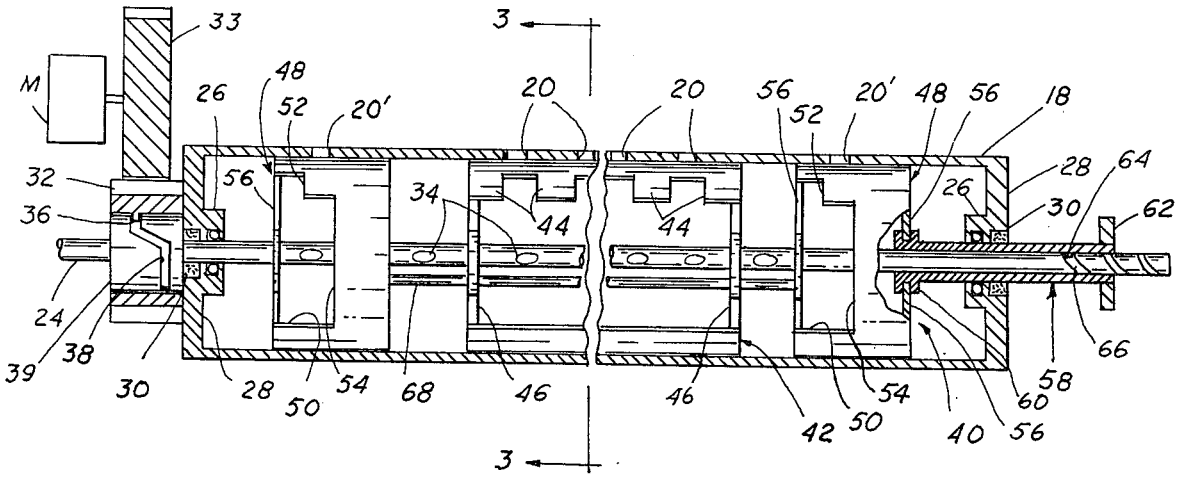
FIG. 2 is an end elevational view of the rotary vacuum feeder/transporter of FIG. 1, partly in section.

Referring now to the drawings, FIG. 1 shows a rotary vacuum feeder/transport 10 located in an apparatus 12 for feeding sheets S seriatim from a tray or hopper 14 and transporting the sheets to a surface 16. The surface 16 may be, for example, a platen of an electrophotographic copier where the sheets are exposed to obtain electrophotographic copies of the information contained on the sheets. The feeder/transporter 10 comprises a hollow cylindrical housing 18 forming a chamber. The housing 18 has a leading series of ports 20 located along an element of the cylinder of the housing and a trailing series of ports 22 located along another element of the cylinder of the housing angularly spaced from the first element (see FIG. 3). As seen in FIG. 2, the housing 18 is supported on a central shaft 24 by bearings 26 fixed to the end walls 28 of the housing such that the shaft is capable of both relative rotary and axial movement with respect to the housing. Seals 30 located in the end walls 28 adjacent the bearings 26 prevent vacuum leakage from the chamber through the bearings. A gear 32, fixed to the external side of one of the end walls 28, is rotated by a gear 33 driven by any appropriate mechanism, such as motor M, to rotate the housing 18 (in a counterclockwise direction when viewed in the direction of FIG. 3). Central shaft 24 comprises a hollow tube having a series of ports 34, the ports being positioned in the tube so that the ports are located within the interior of the chamber formed by housing 18. A vacuum source (not shown) is connected to the shaft 24. The vacuum source communicates through the ports 34 to the chamber to maintain a partial vacuum therewithin. When the lead series of ports 20 or the trailing series of ports 22 are open, the bottom most sheet in the hopper 14 is tacked to outer peripheral surface of housing 18 of the feeder/transporter 10 to feed the sheets along a path defined by the housing surface from the hopper to the surface 16.

The shaft 24 additionally serves to support a control valve 40. The control valve 40 is axially positionable to selectively control the opening of ports 20 and 22 at their proper angular positions to effect feed and transport of sheets seriatim from the hopper 14 to the surface 16. The control valve 40 has a main hollow body portion 42 which is substantially cylindrical in configuration and has an external diameter substantially equal to the internal diameter of the housing 18. The body portion 42 has an opening 43 (see FIG. 3) extending approximately 150° about the circumference of the body, and a series of port-blocking tabs 44 extending in the circumferential direction from the body portion 42 into the opening 43. The tabs 44 are dimensioned to be larger than the ports 20 (or 22). Thus, as the housing 18 rotates, tabs 44 will fully cover (and seal) the ports when the valve 40 is shifted axially to the left, to the position shown in FIG. 4, to align the tabs with the ports.

Figure 6:
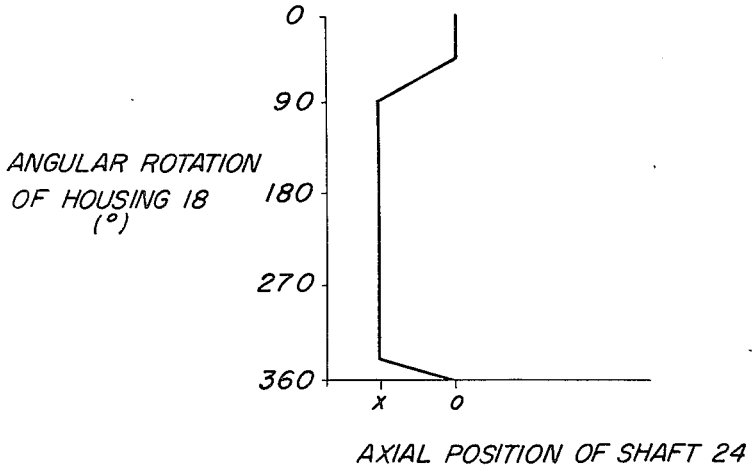
FIG. 6 is a graphical representation plotting the axial position of the shaft of the control valve versus the angular position of the feeder/transporter housing.

In order to effect axial shifting of the valve 40 in timed relation to the angular position of the housing 18 (ports 20 and 22) the body portion 42 of the valve 40 is coupled to the shaft 24 via spokes 46 for axial movement therewith. Axial reciprocation of the shaft 24 is, in turn, effected by a pin-in-groove coupling which times the axial reciprocation of the shaft to the angular position of housing 18. The coupling includes a pin 36 fixedly mounted within the gear 32. The pin rides in a continuous circumferential groove 38 in an enlarged cylindrical portion 39 of the shaft 24. The groove 38 is configured to have a lateral excursion along the axis of the housing 18 to reciprocate the shaft 24 dependent upon the angular position of the gear 32 as shown in the graph of FIG. 6. Thus, the pin-in-groove coupling causes the shaft 24, and therefore the body 42, to move axially relative to the housing 18 (between the positions of FIGS. 2 and 4) as the gear 32 rotates to effect properly timed movement of the body 42, as will be explained hereinbelow.

In addition to the main body portion 42 of the control valve 40, the valve has hollow outboard body segments 48 for controlling the selective opening of outboard ports 20' and 22' (corresponding to ports 20 and 22). The ports 20' and 22' are opened only when handling sheets of extra length (the length of the sheets being measured along the axis of shaft 24), their purpose being to control the marginal edges of the longer sheets. The body segments 48 are similar to the body portion 42 in that they each have an opening 50 extending approximately 150° about the circumference of the respective segment with port-blocking tabs 52 extending in the circumferential direction from the segment into the opening. As is apparent however (see, for example, FIG. 2), the openings 50 extend in from the left hand edge of the body segments 48 about half way thereacross leaving an uninterrupted cylindrical portion 54.

The outboard body segments 48 are coupled to the shaft 24 by a sleeve 58 surrounding the right-hand end portion of the shaft 24 (see, for example, FIG. 2). The coupled relationship between the segments 48 and the shaft 24 causes the segments to move axially with the shaft during the sheet feed/transport cycle, while enabling the segments to be moved relative to the shaft. The change in the relative position of the segments 48 and the shaft 24 is required to reposition the segments and the housing 18 to accommodate the different control for the ports 20' and 22' when feeding sheets of different lengths. The body segments are supported by spokes 56 slidably mounted on the shaft 24. The sleeve 58 is interconnected with the right-hand spoke 56 through a coupling 60 integrally formed with the sleeve. The coupling 60 interacts with the spoke 56 to impart axial movement of the sleeve 58 to the spoke while permitting relative rotation therebetween.

Movement of the sleeve 58 is controlled by an integrally formed internal pin 64 which rides in a substantially helical groove 66 in the shaft 24. Axial movement of the shaft 24 will be imparted to the sleeve 58 through the pin-in-groove connection to move the shaft, sleeve and body segments 48 as a unit in timed relation to the angular position of the housing 18 to selectively open and close ports 20 (20') and 22 (22'). Rotation of the sleeve 58 about the shaft 24 will cause the pin 64 to ride in the groove 66 to provide relative axial movement between the shaft and the sleeve to axially reposition the outboard segments 48. A manually controlled knob 62 is fixed to the end of the sleeve 58 so that the sleeve may be selectively rotated to accomplish the described adjustment. The outboard body segments 48 are interconnected by a rod 68 passing slidably through spokes 46. Thus, the outboard segments 48 will move axially in unison (with the body portion 42 during the feed/transport cycle and relative to the body portion 42 when repositioned by rotation of sleeve 58).

The operation of the above described feeder/transporter 10 is as follows: A stack of sheets S of selected length is placed in the hopper 14 with the forward edge of the stack abutting the forward hopper wall 70 (see FIG. 3). Depending upon the length of the sheets in the stack (in the direction along the axis of shaft 24), the operator turns the knob 62 to rotate sleeve 58 to axially position the outboard body portions 48 of the valve 40 on the shaft 24. When the position of the outboard body segments 48 is set, the vacuum source is energized to establish a partial vacuum within the chamber (formed by housing 18), and the motor M is turned on to initiate drive for gear 32 to rotate the housing 18 to begin a feed/transport cycle.

For normal length sheets (e.g. $8\frac{1}{2} \times 11$ inches), the control valve 40 is initially positioned as shown in FIG. 2. As the housing 18 rotates, the lead series of ports 20 are brought into position under an opening 72 in the floor of the hopper 14 adjacent the forward wall 70, the opening overlying the housing to expose the stack S to the housing (see FIG. 3). At this time the shaft 24 is axially positioned such that the ports 20 are open; i.e., in fluid communication with the interior chamber of the housing 18 (axial position "O" of FIG. 6). The reduced pressure at the ports induced by the vacuum causes the bottom most sheet in the stack S to be tacked to the outer peripheral surface of the housing. As the housing rotates, the tacked sheet is removed from the bottom of the stack and transported toward the surface 16. The rotation of the housing 18 and gear 32 causes the shaft 24 to move axially back and forth, via the pin-in-groove connection between the gear and portion 39 of the shaft, in timed relation to the angular position of the housing between the "O" position and the "X" position according to the graph of FIG. 6 to control the opening and blocking of the ports 20 and 22 during the sheet feed/-transport cycle.

As the housing 18 rotates the trailing ports 22 will progress to the area beneath the opening 72. As this point in the cycle, the angular position of the housing will have changed approximately 90° from the point where ports 20 were beneath opening 72. In this angular position the shaft 24 has been shifted axially (to position "X" in FIG. 6) to move the valve 40 to the position shown in FIG. 4. In this position, the tabs 44 are aligned with the ports 22 to block the ports thereby preventing the vacuum from being operative on the sheet through these ports until, upon continued rotation of housing 18, the ports pass the ends of the tabs. The blocking or ports 22 at this time in the feed/transport cycle performs a two fold purpose. First, it minimizes drag forces on the trailing portion of a transported sheet by preventing the possible application of vacuum through the transported sheet in the area opposite the opening 72; and second, it prevents possible premature feeding of subsequent sheets which might result from the vacuum attraction of the subsequent sheet through the transported sheet.

As the trailing ports 22 pass beyond the tabs 44 to overlie the opening 43 of the valve 40, the vacuum is applied to the sheet through the ports and the sheet is advanced onto the surface area 16 by continued rotation of the housing 18. By utilizing vacuum through both the lead ports 20 and the trailing ports 22, control is maintained over a transported sheet to insure accurate transport onto the surface 16, even after ports 20 are blocked by the valve body 42. After the ports 22 pass beyond the opening 43, the ports 22 are closed by the body 42 and the transported sheet is no longer under the influence of vacuum. Due to static attraction forces, the transported sheet may adhere to housing 18. Therefore, a sheet stripper 74 is provided to separate the lead edge of the sheet from the rotating housing 18 and direct the sheet, as it is transported by the vacuum attraction thereof to the housing 18 through ports 22, onto the surface 16.

Figure 3:
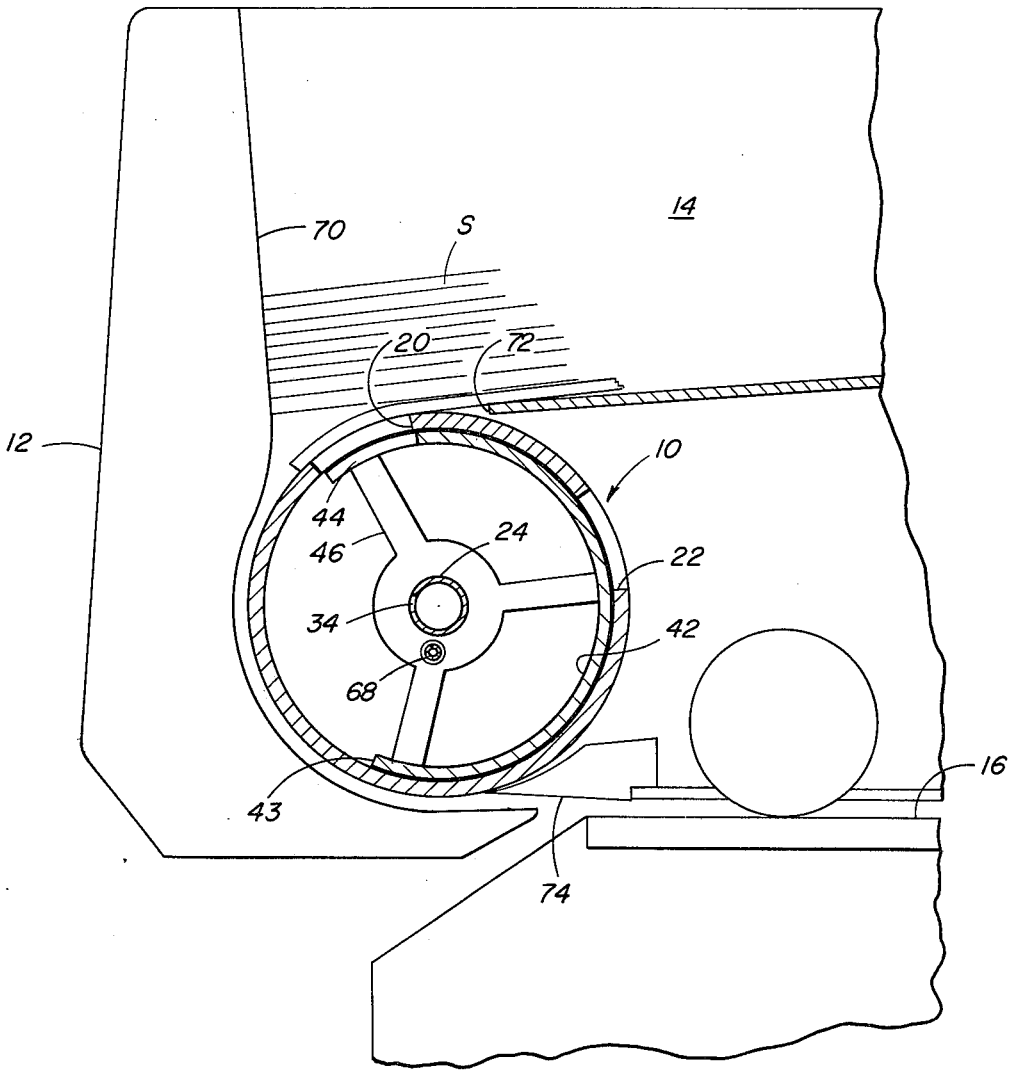
FIG. 3 is a side elevational view of the apparatus of FIG. 1, partly in section, taken generally along the lines 3—3 of FIG. 2.

The valve 40 maintains its axial position with the tabs 44 aligned for blocking the ports 20 and 22 until the leading ports 20 have substantially returned to the position of FIG. 3, a rotation by the housing 18 of at least 345° (note FIG. 6). The blocking action of the lead ports 20 until they are once again positioned fully beneath the opening 72 will prevent drag forces on the trailing edge of any sheet not fully removed from the hopper 14 at this time in the feed/transport cycle. As the housing 18 is rotated through its final approximately 15° to accomplish a full 360° rotation, the valve 40 is axially shifted to its original position (FIG. 2 and "O" in FIG. 6) for subsequent feed/transport cycles of sheets in the stack S seriatim.

Figure 4:
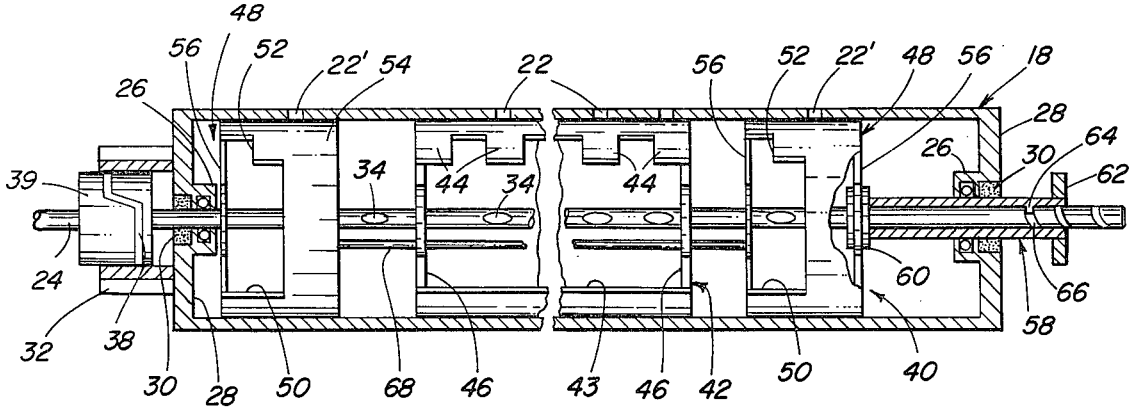
FIGS. 4 and 5 are end elevational views of the rotary vacuum feeder/transporter similar to FIG. 2, with the control valve moved to different operative positions.
Figure 5:
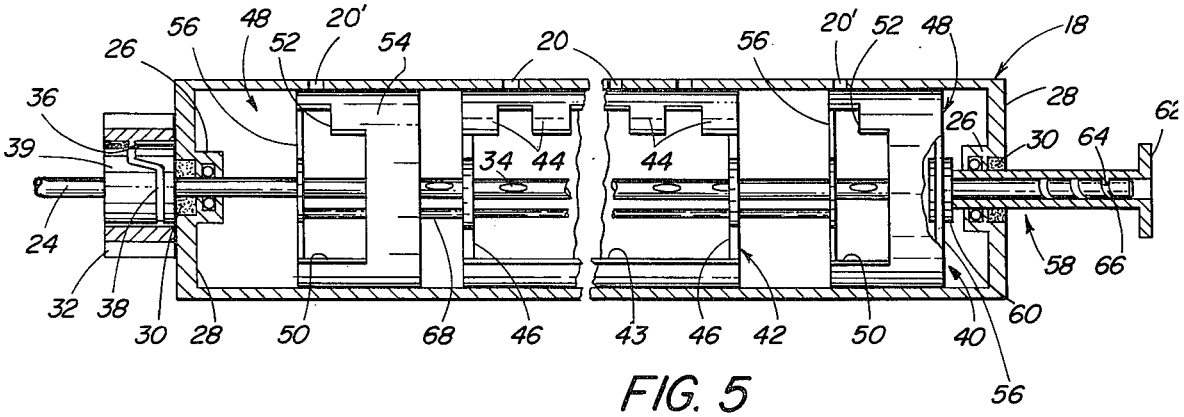

As is apparent from FIGS. 2 and 4, the outboard body segments 48 of the valve 40 were positioned axially on the shaft 24 (relative to body portion 42), during the described operation, such that the outboard ports 20′ and 22′ were closed by the tabs 52 or the cylindrical portions 54 through the entire feed/transport cycle. Such closure was necessary to prevent loss of vacuum through the outboard ports (which were not covered by the shorter length sheets). When the sheets in the stack in the hopper 14 are of extra length (such as, for example 11 × 17 inches) the outboard body segments 48 are shifted axially to the right relative to shaft 24 (by operator rotation of the knob 62) to the position of FIG. 5. With the segments 48 so located, the opening 50 and the tabs 52 will be selectively aligned with the ports 20′ and 22′ by the axial movement of the shaft 24 upon rotation of the housing 18 to control the fluid communication of the ports 20′ and 22′ with the interior of the chamber formed by the housing. Repetition of the above described operative cycle will thus effect controlled feeding and transport of the larger sheets from the hopper 14 with the main body portion 42 and the outboard body segments 48 shifting axially in unison to respectively close the ports 20 and 22 and 20′ and 22′ at predetermined time intervals with respect to the angular position of housing 18 to accomplish the stated purpose (i.e., to reduce drag on transported sheets and prevent possible premature feeding of subsequent sheets).

From the foregoing it is apparent that there is herein provided an efficient apparatus for feeding sheets seriatim from a stack and transporting the sheets to a remote location without inducing undue drag forces on the transported sheets. The feeder/transporter apparatus has a ported cylindrical vacuum housing mounted for rotation about an axis located to position the outer surface of the housing for movement in a path from adjacent to a stack of sheets toward the remote location to which the sheets are to be transported. An internal control valve selectively controls the opening and closing of the ports in the housing to feed and transport the sheets while preventing drag on transported sheets or possible premature feeding of subsequent sheets. The control valve accomplishes its function by axially reciprocating in timed relationship to the rotation of the cylindrical housing.

The invention has been described in detail with particular reference to preferred embodiments thereof, but it will be understood that variations and modifications can be effected within the spirit and scope of the invention.

We claim:

1. Apparatus for feeding and transporting sheets of a stack seriatim from stack supporting means to a remote location, said apparatus comprising:

a housing defining a chamber, at least a portion of said housing being cylindrical, having an external peripheral surface for receiving sheets and an internal surface, said housing including a first series of ports arranged along an element of the said cylindrical portion of said housing providing fluid communication between said chamber and external peripheral surface, and a second series of ports arranged along another element of said cylindrical portion angularly spaced from said element along which said first series of ports are arranged;

means for mounting said housing to rotate about a longitudinal axis of said cylindrical portion of said housing, said axis being spaced from the stack supporting means a distance such that at least a portion of the external peripheral surface of said housing defines a travel path for sheets, received on said external peripheral surface, from the stack supporting means to the remote location;

means for establishing a reduced pressure atmosphere within said chamber of said housing;

valve means mounted within said housing for reciprocating movement in sliding contact with said internal surface of said cylindrical portion of said housing to selectively open and close said first and second series of ports; and means for rotating said housing and for reciprocating said valve means in timed relationship to open said first series of ports at such time as such ports are adjacent to the stack supporting means to tack a sheet to said external peripheral surface of said cylindrical portion of said housing, and to close said second series of ports at such time such ports are adjacent to the stack supporting means so that sheets tacked to the external peripheral surface are not subjected to increased friction drag forces caused by sliding contact with other sheets in the stack supporting means.

2. The invention of claim 1 wherein said valve means includes a shaft extending through said housing coincident with said longitudinal axis of said housing, said shaft being reciprocable along said longitudinal axis so as to impart axial movement to said valve means.

3. The invention of claim 2 wherein said means for rotating said cylindrical housing and reciprocating said valve means in timed relationship includes a member surrounding said shaft, said member being fixed to said housing, a drive motor for rotating said member and said housing, a continuous circumferential groove in either said member or said shaft, said groove having a predetermined lateral excursion in the direction of said longitudinal axis of said shaft, and a pin extending from the other of said member or said shaft into said groove, whereby upon rotation of said member and said housing by said drive motor, said shaft is reciprocated through the pin-in-groove connection between said member and said shaft to the extent of the lateral excursion dependent upon the angular position of said member.

4. In an apparatus for feeding and transporting sheets of a stack seriatim from stack supporting means to a remote location, a rotary vacuum feeder/transporter comprising:

a hollow cylindrical housing defining a chamber having internal and external peripheral surfaces, said housing having a first series of ports arranged along an element of said housing providing flow communication between the internal and external peripheral surfaces of said chamber, and a second series of ports arranged along another element of said housing angularly spaced from said element along which said first series of ports are arranged;

means for mounting said housing for rotation about the longitudinal axis thereof, said axis being located such that said external peripheral surface of said chamber defines a travel path from said stack supporting means to said remote location;

a hollow shaft connected to a vacuum source, said hollow shaft being mounted coincident with said longitudinal axis of said housing, said hollow shaft having a series of ports providing flow communication from the interior of said shaft to the interior of said chamber, said housing and said hollow shaft being capable of relative rotational and axial movement;

a control valve located within the chamber of said cylindrical housing, said control valve comprising a valve body shaped to be complimentary with at least a portion of the internal surface of said housing, said valve body having an opening over a portion of said valve body and a series of port-blocking sections extending from said valve body into said opening, means for connecting said valve body to said shaft for reciprocation therewith to move said valve body in sliding contact with the internal surface of said housing; and means for rotating said cylindrical housing and reciprocating said valve body in timed relationship to open said first series of ports at such time as such ports are adjacent to the stack supporting means to tack a sheet to said external peripheral surface of said cylindrical portion of said housing, and to close said second series of ports at such time such ports are adjacent to the stack supporting means so that sheets tacked to the external peripheral surface are not subjected to increased friction drag forces caused by sliding contact with other sheets in the stack.

5. The invention of claim 4 wherein said means for rotating said cylindrical housing and reciprocating said valve body in timed relationship includes a member surrounding said hollow shaft, said member being fixed to said housing, a drive motor for rotating said member and said housing, a continuous circumferential groove in either said member of said hollow shaft, said groove having a predetermined lateral excursion in the direction of said longitudinal axis of said hollow shaft, a pin extending from the other of said member or said hollow shaft into said groove, whereby upon rotation of said member and said housing by said drive motor, said hollow shaft is reciprocated through the pin-in-groove connection between said member and said hollow shaft, to the extent of the lateral, excursion dependent upon the angular position of said member.

6. The invention of claim 4 wherein said control valve further includes at least one outboard body segment shaped to be complimentary to a portion of the internal surface of said housing, said at least one outboard body segment having an opening over a portion of said body and a port-blocking section extending from said body into said opening, means for supporting said at least one outboard body segment on said hollow shaft for reciprocation with respect thereto, and means for coupling said at least one outboard body segment to said shaft in a first position to move said at least one outboard body segment with said hollow shaft in sliding contact with said internal surface of said housing so that outboard ports of said first and second series of ports in said housing are maintained closed, and in a second position to move said at least one outboard body segment with said shaft in sliding contact with said internal surface of said housing so that said outboard ports of said first series of ports are opened at such time as such ports are at a point in the travel path adjacent to said stack supporting means to tack the marginal edge of a sheet to said external peripheral surface of said housing, and to close said outboard ports of said second series of ports at such time as said ports are at a point in the travel path adjacent to said stack.

7. The invention of claim 6 wherein said means for coupling said at least one outboard body segment to said hollow shaft includes a sleeve surrounding a portion of said shaft, means for connecting said sleeve to said means for supporting said at least one outboard body segment such that said sleeve imparts reciprocation to said support means and rotates relative thereto, means for rotating said sleeve, a helical circumferential groove in either said sleeve or said hollow shaft, and a pin extending from the other of said sleeve or said shaft into said groove whereby, through the pin-in-groove connection, reciprocation of said shaft is imparted to said sleeve, and rotation of said sleeve causes said sleeve to move axially with respect to said shaft between said first and second positions.

8. The invention of claim 6 wherein said control valve further includes a pair of outboard body segments, said pair of outboard segments being interconnected so as to reciprocate in unison.

* * * * *